United States Patent [19]

Gentiluomo

[11] 3,938,809

[45] Feb. 17, 1976

[54] GOLF GAME

[76] Inventor: Joseph A. Gentiluomo, 1456 Belmont Ave., Schenectady, N.Y. 12308

[22] Filed: Sept. 28, 1973

[21] Appl. No.: 401,615

Related U.S. Application Data

[62] Division of Ser. No. 204,890, Dec. 6, 1971, Pat. No. 3,784,207.

[52] U.S. Cl.... 273/176 FA; 235/92 GA; 273/184 R

[51] Int. Cl.[2]..... A63B 69/36; A63B 67/02

[58] Field of Search ..... 273/176, 184, 185, 35

[56] References Cited

UNITED STATES PATENTS

| | | | |
|---|---|---|---|
| 1,994,706 | 3/1935 | Hincks | 273/184 R X |
| 3,091,466 | 5/1963 | Speiser | 273/185 R |
| 3,559,996 | 2/1971 | Hopp | 273/176 FA |
| 3,778,064 | 12/1973 | Nutter | 273/176 FA |
| 3,784,207 | 1/1974 | Gentiluomo | 273/176 FA |

*Primary Examiner*—George J. Marlo

[57] ABSTRACT

An apparatus for playing a golf game based on the momentum of propelled golf balls. The apparatus includes a golf tee from which golf balls are hit, an upright target for halting the balls propelled from the tee, and a ball momentum determining and indicating package for providing a numerical momentum magnitude representation for each ball propelled toward the target with either tee or fairway type golf clubs. The ball momentum determining and indicating package includes a time sequence signal producing device for providing a discrete sequence of intermittent timed signals based on ball traverse time from tee to target, a numeric indicating device for translating the intermittent timed signals to provide ball momentum magnitude representation, a sensing device disposed with respect to the tee for activating the time sequence signal producing device when a ball is dislodged from the tee, and sensing units disposed with respect to the target for de-activating the time sequence signal producing device when a ball hits the target. For playing the game, each player hits a predetermined number of balls with each predetermined type of club. The resulting score of each shot is displayed on the numeric indicating device situated on a score table located at the golf tee area.

6 Claims, 1 Drawing Figure

GOLF GAME

Figure 1:
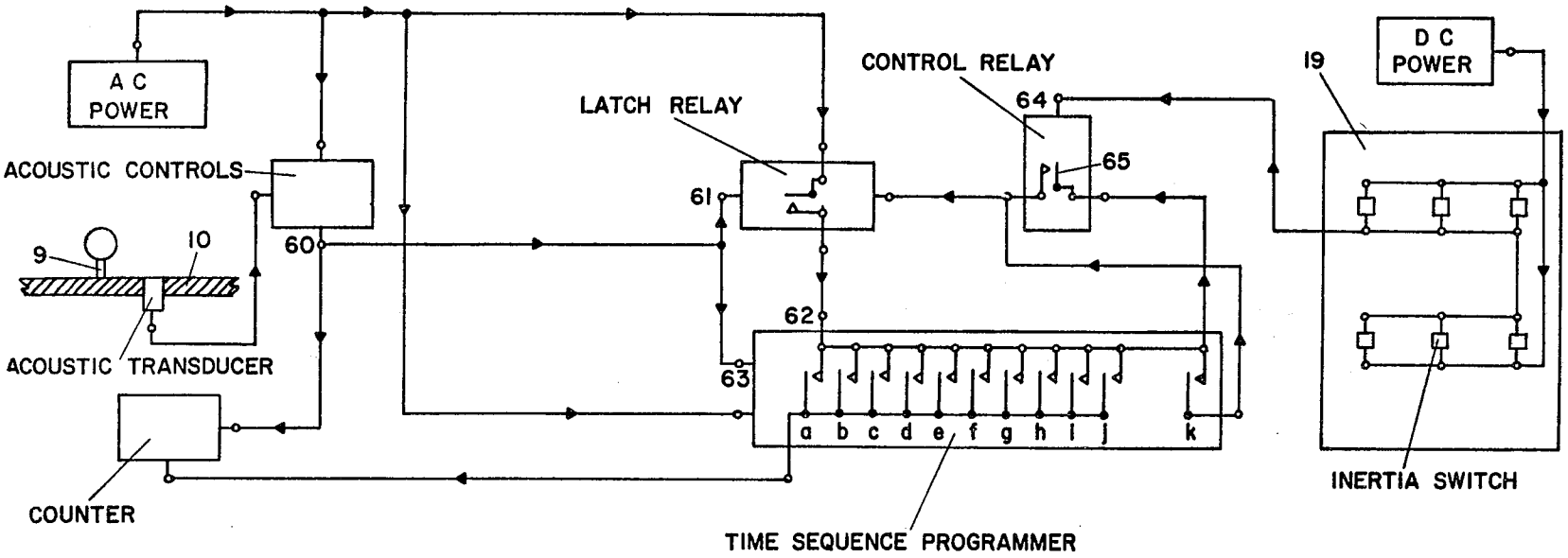

This application is a division of application Ser. No. 204,890, filed Dec. 6, 1971, now U.S. Pat. No. 3,784,207.

The aim of this invention is to provide a golf game apparatus that will aid the golfer in developing greater power for hitting a golf ball.

Accordingly, other objects of this invention are as follows:

To provide a golf game apparatus adaptable for use both indoors and outdoors.

To provide a golf game apparatus which accommodates the use of wood, long iron, medium iron, and short iron clubs.

To provide a golf game adaptable to a game rating such as men's and women's par, so that golfer handicaps can be established.

To provide a golf game adaptable to both league and tournament play.

To provide a golf game apparatus whereby a ball momentum representation score is provided for every shot hit from the tee.

To provide a game scoring system that can be adapted with a score projection unit to display player scores for spectator viewing.

These objects and other objects of this invention should be discerned and appreciated from the description and claims taken in conjunction with the accompanying drawing in which:

FIG. 1 depicts a schematic showing of the invention.

In explaining the invention in detail, it can be discerned that this invention is capable of many embodiments of which the preferred is herein described and illustrated in the associated drawing.

With reference to FIG. 1, it can be readily discerned that the invention includes a golf tee 10 locatable at one end of a play area, an upright target 19 disposed at the opposite end, and ball momentum determining and indicating means. Said ball momentum determining and indicating means include an acoustic transducer with controls, one or more inertia switches, a time sequence programmer, a latch relay, a control relay, a counter, and a D.C. power supply unit.

Target 19 can be fabricated from a material such as reinforced plastic sheet and erected by use of conventional means. Said target contains a plurality of ball-to-target impact sensing means such as inertia switches strategically and properly mounted thereupon for detecting ball impact regardless of where said ball hits said target. Said inertia switches will be electrically interconnected in parallel so that actuation of any one or any number of them will operate to provide a signal for control purposes. The terms inertia switch, acceleration switch, and G-switch are used synonymously in the art to refer to an acceleration sensitive device.

The acoustic sensing system, the counter, the control relay, the latch relay, the inertia switches, the time sequence programmer, and the D.C. power supply are standard commercially available components. It is to be noted that equivalent devices classified as fluidic, electronic, electromechanical, etc., can be substituted for the above cited components without departing from the teachings of the invention.

Terms herein utilized should bear interpretation such as follows:

Time Sequence Programmer— It is a time sequence signal producing means for providing time sequenced signals or sequentially timed output control pulses.

Sensing Means for Initiating the Time Sequence Signal Producing Means— It is to be construed as acoustic or ultrasonic sensing units, photoelectric sensing units, inertia switches, etc.

Sensing Means for Terminating the Time Sequence Signal Producing Means— It is to be construed as inertia switches, ultrasonic sensing units, photoelectric sensing units, etc.

Since ball momentum is dependent on the velocity at which the ball leaves the golf club head or the average velocity of said ball in flight, such trajectory parameters as distance from the golf ball tee to said target and the time required for said ball to travel said distance could be utilized for numerical classification exemplifying said ball momentum representation. As can be discerned, said ball momentum designation can therefore be represented by the time required for the ball to travel from said tee to said target. For a tee-to-target distance of 50 feet, the following typical scoring system could be utilized to represent ball momentum.

| Momentum Factor Score | Momentum Parameters | |
|---|---|---|
| | Average Vel.(ft/sec) | Time (sec) |
| 1 | ∞ to 200 | 0 to .250 |
| 2 | $200^-$ to 180 | $.250^+$ to .278 |
| 3 | $180^-$ to 160 | $.278^+$ to .312 |
| 4 | $160^-$ to 140 | $.312^+$ to .357 |
| 5 | $140^-$ to 120 | $.357^+$ to .417 |
| 6 | $120^-$ to 100 | $.417^+$ to .500 |
| 7 | $100^-$ to 80 | $.500^+$ to .625 |
| 8 | $80^-$ to 60 | $.625^+$ to .833 |
| 9 | $60^-$ to 40 | $.833^+$ to 1.250 |
| 10 | $40^-$ to 0 | $1.250^+$ to ∞ |

Ball momentum is defined as the product of ball mass and its velocity. Since ball mass is constant, said momentum can be represented by velocity or the time required for said ball to travel the fixed distance between said tee and target.

A ball hit by an average male golfer with a driver into the target will probably hit said target at an average velocity of 200 feet per second or within a time of 0.250 seconds, and therefore said shot will be scored as 1. When hit with an average velocity of 120 feet per second or within a time of 0.417 seconds, the score will be 5. When hit with an average velocity of 140 feet per second or within a time of 0.357 seconds, the score will be 4.

A ball hit by an average male golfer with a 5-iron into the target will probably hit said target at an average velocity of 150 feet per second or within a time of 0.333 seconds, and therefore said shot will be scored as 4.

A ball hit by an average male golfer with a 7-iron into the target will probably hit said target at an average velocity of 140 feet per second or within a time of 0.357 seconds, and therefore said shot will be scored as 4.

A ball hit by an average male golfer with a 9-iron into the target will probably hit said target at an average velocity of 130 feet per second or within a time of 0.385 seconds, and therefore said shot will be scored as 5.

All balls not hitting said vertical target will be scored as 10. By completely missing said target, the golfer is penalized for poor performance by an assessment of zero velocity or infinitely great tee-to-target time for the shot, thereby, subject to an automatic imposition of a momentum factor score of 10.

It is to be discerned that the above cited scores can be displayed on a counter situated at a score table located adjacent to each golf tee. Such scores can in turn be recorded by players onto a score sheet positioned on said score table. A score projector unit attached to said table can then be used to project said scores from said score sheet onto a screen for spectator viewing.

With reference to FIG. 1, it can be discerned that when the ball is dislodged from the golf ball tee 9 the acoustic transducer picks up the sound of impact and transmits the signal to the acoustic controls which in turn operates to emit an output pulse from terminal 60. Said pulse will be conveyed to the indicating device or counter to reset it to a zero count, and through to terminal 61 of the latch relay to effectuate the closing of its normally open contacts for conveyance of power therethrough to terminal 62 of the time sequence programmer. Also, said pulse will be conveyed to terminal 63 of said programmer to inititate its operation. After activation, said programmer such as an electromechanical single cycle multi-cam timing programmer will immediately emit a pulse from terminal (*a*) to the counter to register a momentum factor count of 1 therein. If the said ball hits the vertical target 19 within 0.250 seconds, the inertia switches will operate and power will be conveyed therethrough to provide a pulse to terminal 64 of the control relay. This pulse will cause a momentary closure of contacts 65 such that the release coil of said latch relay is momentarily energized to return its contacts to the initial normally open condition for termination of power to said programmer by way of terminal 62. This means that the said programmer is de-activated at a momentum factor score of 1 and at the end of the programed cycle, all output contacts will assume the normally open position at reset.

If said ball does not hit said target 19 within 0.250 seconds, said programmer will continue to operate and at $0.250^+$ seconds a second pulse will be emitted from terminal (*b*) to the counter. If said ball hits said target within 0.278 seconds, said programmer will be de-activated as previously stated, and a momentum factor count of 2 will remain registered on said counter.

If said ball does not hit said target within 0.278 seconds, said programmer will continue to operate and at $0.278^+$ seconds a third pulse will be emitted from terminal (*c*) to advance the counter. If said ball hits said target within 0.312 seconds, said programmer will be de-activated and a momentum factor count of 3 will remain registered on said counter.

If said ball does not hit said target within 0.312 seconds, said programmer will continue to operate and at $0.312^+$ seconds a fourth pulse will be emitted from terminal (*d*) to advance the counter. If said ball hits said target within 0.357 seconds, said programmer will be de-activated and a momentum factor count of 4 will remain registered on said counter.

If said ball does not hit said target within 0.357 seconds, said programmer will continue to operate and at $0.357^+$ seconds a fifth pulse will be emitted from terminal (*e*) to advance the counter. If said ball hits said target within 0.417 seconds, said programmer will be de-activated and a momentum factor count of 5 will remain registered on said counter.

If said ball does not hit said target within 0.417 seconds, said programmer will continue to operate and at $0.417^+$ seconds a sixth pulse will be emitted from terminal (*f*) to advance the counter. If said ball hits said target within 0.500 seconds, said programmer will be de-activated and a momentum factor count of 6 will remain registered on said counter.

If said ball does not hit said target within 0.500 seconds, said programmer will continue to operate and at $0.500^+$ seconds a seventh pulse will be emitted from terminal (*g*) to advance the counter. If said ball hits said target within 0.625 seconds, said programmer will be de-activated and a momentum factor count of 7 will remain registered on said counter.

If said ball does not hit said target within 0.625 seconds, said programmer will continue to operate and at $0.625^+$ seconds an eighth pulse will be emitted from terminal (*h*) to advance the counter. If said ball hits said target within 0.833 seconds, said programmer will be de-activated and a momentum factor count of 8 will remain registered on said counter.

If said ball does not hit said target within 0.833 seconds, said programmer will continue to operate and at $0.833^+$ seconds a ninth pulse will be emitted from terminal (*i* ) to advance the counter. If said ball hits said target within 1.250 seconds, said programmer will be de-activated and a momentum factor count of 9 will remain registered on said counter.

If said ball does not hit said target within 1.250 seconds, said programmer will continue to operate and at $1.250^+$ seconds a tenth pulse will be emitted from terminal (*j*) to advance the counter. Now, all balls hereonafter whether hitting the target or not will register a momentum factor count of 10.

If a ball driven from said tee 9 does not hit said vertical target, the programmer will operate to emit one pulse from each terminal from (*a*) through (*j*) of said programmer, thus providing 10 consecutive pulses to the counter to register a count of 10 thereupon. After a time delay, such as 3 seconds, a pulse will be emitted from terminal (k) of said programmer. The pulse from terminal (k) will operate the release coil of the latch relay to return its contacts to the normally open condition such that power is terminated to the programmer through terminal 62.

It is to be noted that each pulse emitted from terminals (*a*) through (*j*) represents an incremental range of ball velocities.

Having thusly described the invention, the following is claimed:

1. A golf game apparatus, comprising a golf ball tee from which golf balls are hit, an upright target for halting balls propelled from said tee, and ball momentum determining and indicating means functionally associated with said tee and said target to provide a numerical momentum magnitude representation for each ball propelled toward said target with either tee or fairway type golf clubs; said ball momentum determining and indicating means include time sequence signal producing means for providing one or more pulses of which each pulse represents a predetermined increment of ball velocities, and a remotely interconnected numeric indicating device operative in receiving and translating said pulses to provide a numeric display of said momentum magnitude representation.

2. The invention as defined by claim 1, wherein said ball momentum determining and indicating means is further characterized as including sensing means disposed with respect to said tee and operative in initiating said time sequence signal producing means to emit said pulses when a ball is dislodged from said tee.

3. The invention as defined by claim 2, wherein said ball momentum determining and indicating means is further characterized as including sensing means disposed with respect to said target and operative in terminating the signal emission of said time sequence signal producing means when said ball hits said target.

4. The invention as defined by claim 3, wherein said indicating device is further characterized as a counter.

5. The invention as defined by claim 4, wherein said sensing means for initiating the operation of said time sequence signal producing means is further characterized as an acoustic sensing unit, and said sensing means operative in terminating the signal emission of said time sequence signal producing means is further characterized as one or more inertia switches.

6. The invention as defined by claim 5, wherein said time sequence signal producing means is further characterized as comprising a time sequence programmer.

* * * * *